US005448894A

United States Patent [19]

Niblock et al.

[11] Patent Number: 5,448,894

[45] Date of Patent: Sep. 12, 1995

[54] DISK FLAKE ICE MACHINE

[75] Inventors: Robert R. Niblock, Hawthorne, Australia; Don S. Bartholmey, Bellevue, Wash.

[73] Assignee: North Star Ice Equipment Corporation, Seattle, Wash.

[21] Appl. No.: 310,121

[22] Filed: Sep. 21, 1994

[51] Int. Cl.[6] ..... F25C 5/12

[52] U.S. Cl. ..... 62/71; 62/354

[58] Field of Search ..... 62/354, 71; 165/94; 384/271

[56] References Cited

U.S. PATENT DOCUMENTS

| | | | |
|---|---|---|---|
| 171,267 | 12/1875 | Cook | 62/341 |
| 518,618 | 4/1894 | Mendes . | |
| 2,054,841 | 9/1936 | Taylor | 62/106 |
| 2,280,320 | 4/1942 | Taylor | 62/354 X |
| 2,659,212 | 11/1953 | Lees | 62/106 |
| 2,735,275 | 2/1954 | Branchflower | 62/107 |
| 3,159,986 | 12/1964 | King | 62/354 |
| 3,191,398 | 6/1965 | Rader | 62/354 X |
| 3,662,564 | 5/1972 | Clearman et al. | 62/320 |
| 3,863,462 | 2/1975 | Treuer | 62/345 |
| 4,185,467 | 1/1980 | Garland | 62/81 |
| 4,292,816 | 11/1981 | Gartzke | 62/347 |
| 4,420,949 | 12/1983 | Bartholmey et al. | 62/354 |
| 4,527,401 | 7/1985 | Nelson | 62/354 |
| 4,538,428 | 9/1985 | Wilkerson | 62/354 |
| 4,669,277 | 6/1987 | Goldstein | 62/354 |
| 5,307,646 | 5/1994 | Niblock | 62/345 |

FOREIGN PATENT DOCUMENTS

| | | | |
|---|---|---|---|
| 408032 | 3/1910 | France . | |
| 3300013 | 7/1984 | Germany . | |
| 0225956 | 9/1990 | Japan | 62/66 |
| 1460095 | 12/1976 | United Kingdom . | |
| 1502607 | 3/1978 | United Kingdom . | |
| 85/03996 | 9/1985 | WIPO . | |
| 89/01120 | 2/1989 | WIPO . | |

*Primary Examiner*—William E. Tapolcai
*Attorney, Agent, or Firm*—Christenson, O'Connor, Johnson & Kindness

[57] ABSTRACT

A disk flake ice machine (10) includes a cooling member (12) mounted for rotation about an axis(52) and defining a first and second annular cooling surfaces (24) and a peripheral edge (25) in which is formed an annular groove (32). A motor (16) drives rotation of the cooling member. A refrigerant supply (18) supplies refrigerant to cool the cooling member. Liquid material to be frozen is introduced to the cooling surfaces of the cooling member by spray tubes (28). Ice removal blades (30) are disposed adjacent the cooling surfaces of the cooling member to remove flakes of frozen material. A guide member (34) engages the groove in the peripheral edge of the cooling member to limit wobble of the cooling member relative to the ice removal tools during rotation.

19 Claims, 2 Drawing Sheets

DISK FLAKE ICE MACHINE

FIELD OF THE INVENTION

The present invention relates to machines for freezing liquid material into solid form, and particularly, to machines for producing flake ice.

BACKGROUND OF THE INVENTION

Machines that continuously and automatically produce large quantities of flake ice are well known for use by the food processing industry, onboard seafood processing ships, within grocery food stores, and for cooling concrete in construction. Flake ice machines have been developed that utilize a rotating cooling disk that is cooled by flow of a refrigerant through internal passages formed in the disk. Water or other liquid to be frozen is introduced to a portion of the side surfaces of the rotating disk, is sub-cooled, and is then removed as the disk rotates between a pair of ice removal blades positioned adjacent the side surfaces of the disk. An example of such a conventional flake ice machine is disclosed in U.S. Pat. No. 5,307,646 to Niblock, the disclosure of which is hereby expressly incorporated by reference.

In such conventional disk ice machines, the cooling disk is mounted on a hub for rotation about the central axis of the disk. As with all manufactured pans, disks tend to exhibit some axial runout, which causes the circumferential edge of the disk to wobble during rotation. The ice removal tools on each side of the disk must be spaced apart from the side surfaces of the disk to accommodate the disk wobble and to avoid the blades contacting the disk surfaces. Such contact would result in rapid wear of the disk surfaces. The wobble effect is most pronounced at the circumferential edge of the disk, and thus this determines the spacing of the blades relative to the disk. In conventional flake ice machines, a clearance of approximately 0.010 to 0.012 inches is maintained between each rigidly mounted blade and the corresponding disk surface to prevent premature wear of the disks, which are costly to produce.

However, the spacing required between the disk and the ice removal blades of conventional machines places the blades further from the shear joint defined between the frozen ice and the underlying disk surface. This makes removal of the ice more difficult. In some instances, the blades incompletely remove ice from the cooling surfaces, and a tough layer or bumps of ice will stubbornly remain on the disk after passing through the blades. This effect is especially pronounced nearer the peripheral edge of the disk, because of the high structural strength of the ice formed at the annular outer corners of the disk. Further, because of the inherent flexibility of the metal materials from which cooling disks are formed, the radially outer edge of the disk is readily deflected during rotation by the blades pushing against strongly adhered ice. Problems of incomplete ice removal and disk wobble are most pronounced near the radially extreme portions of conventional disks.

Typically, conventional flake ice machines used to produce ice must be supplied with water having a small quantity of salt that is added to increase ductility of the ice, and to facilitate complete removal of ice from the cooling surfaces in large flakes. A salinity of 150–1,000 ppms, and most typically 250–500 ppms, is conventionally utilized to facilitate ice removal. Conventional disks may be outfitted with resiliently mounted blades or flexible blades for use in making salt-containing ice. The use of flexible or resiliently mounted blades is intended to eliminate or to permit reduction in the clearance between the blades and the disk. However, the use of salt is often undesirable for ice used for some purposes, including ice being used to cool food in grocery stores. Because fresh water ice is more difficult to remove, and particularly to remove in desirably large flakes rather than smaller pieces, a rigidly mounted blade must be utilized to develop the required shear force. As noted previously, the use of rigid blades requires the maintenance of a large clearance between the blades and the disks. As a result, many conventional flake ice machines are not suitable for the production of fresh water ice.

Another conventional flake ice machine disclosed in U.S. Pat. No. 5,157,939 to Lyon et al. attempts to deal with the problem of axial runout of the disk by utilizing a harvesting blade assembly that carries a bearing block to position the disk. The bearing block contacts either side of the disk at a location radially offset from the ice harvesting blades. However, this design is not very effective, because it merely causes the harvesting blade assembly to move axially, following the disk, in response to runout of the disk. Further ice tends to build up between the flat bearing block surfaces and the flat disk surfaces, thus still resulting in undesirable deflection of the disk relative to the ice harvesting blades.

SUMMARY OF THE INVENTION

The present invention provides an improved flake ice machine for producing flakes of a frozen material, including a cooling member mounted for rotation about an axis, and defining an annular cooling surface and a peripheral edge about the axis. A motor is coupled to the cooling member to drive rotation of the cooling member. Refrigerant is supplied in thermal communication with the cooling member to cool the cooling surface. A liquid material to be frozen is supplied to the cooling surface of the cooling member. A removal tool is disposed adjacent the cooling surface of the cooling member to remove flakes of frozen material. The peripheral edge of the cooling member is engaged to limit wobble of the cooling member relative to the removal tool during rotation.

In a preferred embodiment of the invention, the cooling member is a disk that is mounted for rotation and that defines first and second cooling surfaces and a circumferential edge. First and second removal tools are disposed adjacent the first and second cooling surfaces of the cooling disk, respectively, to remove flakes of frozen material from both surfaces. A guide member is disposed proximate to and engaged with the circumferential edge of the cooling disk to locate the disk between the first and second removal tools during rotation.

A method is also disclosed for producing flakes of the frozen material from a disk constructed in this manner.

The present invention thus provides an improved disk flake ice machine in which the edge of the disk is engaged to limit wobble or axial runout of the disk. Because wobble of the disk is controlled, it is possible to significantly reduce the clearance gap between the ice removal tools and the disk cooling surfaces. Because the disk is constrained at the peripheral edge from deflecting away from the blades, greater force can be exerted for removal of frozen material. The flake ice machine of the present invention is thus well suited for freezing not only water to which salt has been added and other aqueous solutions, but also for freezing of fresh water.

The guide member of the present invention also serves to remove frozen material from the peripheral edge of the disk. This increases the effective cooling area of the disk cooling member slightly, and also assists in breaking the structurally strong frozen ice at the annular corner edges of the disk.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION OF THE PREFERRED EMBODIMENT

Figure 1:
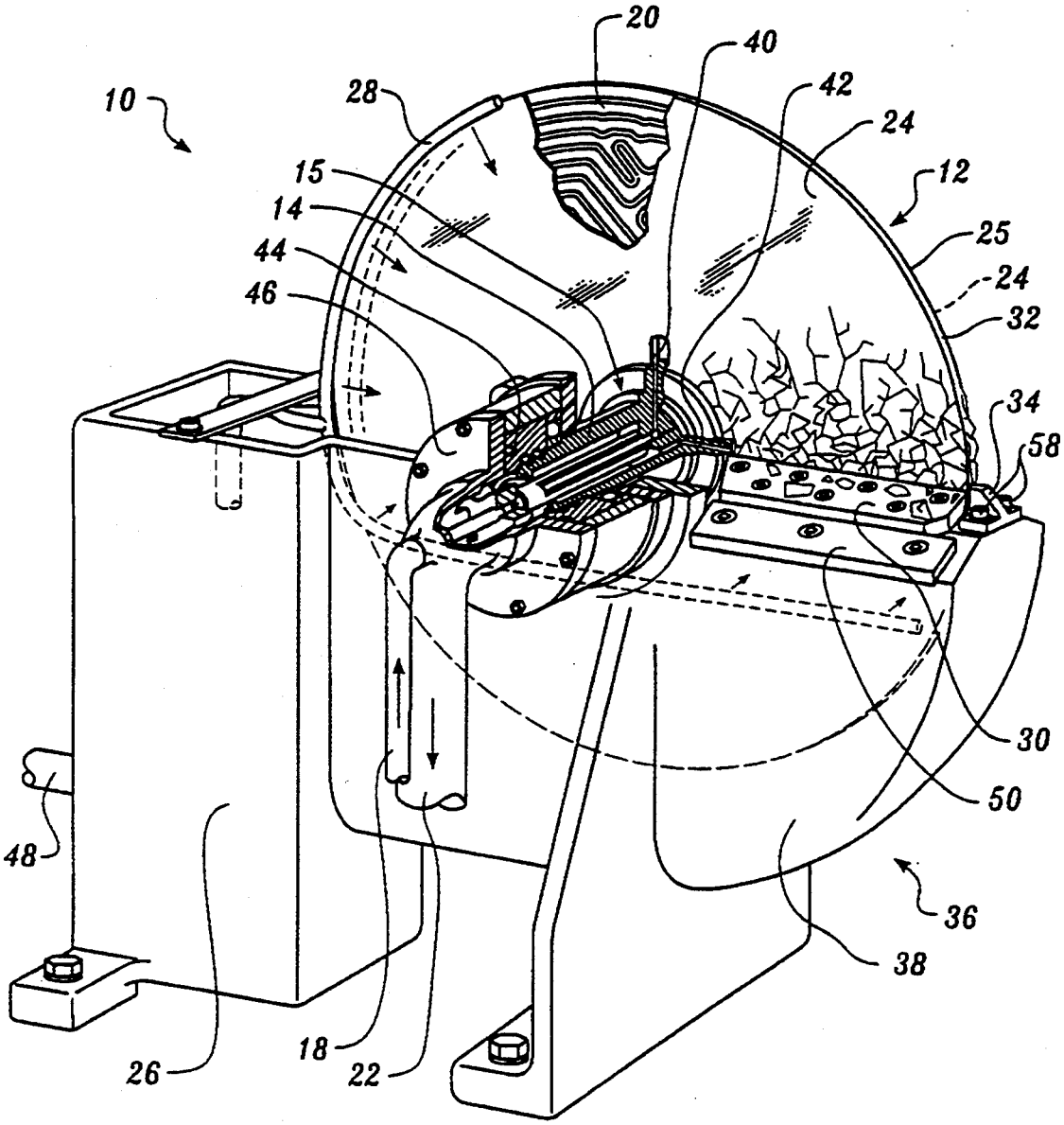
FIG. 1 provides a pictorial view of a flake ice machine constructed in accordance with the present invention, with the hub on which the cooling disk is mounted being shown in partial section to illustrate the flow of refrigerant to and from the disk, and with a portion of the outer surface of one side of the disk being shown removed to illustrate the internal refrigerant flow paths.

A flake ice machine 10 constructed in accordance with the present invention is shown in FIG. 1. The flake ice machine includes a disk cooling member 12 mounted on a shaft 14 of a hub assembly 15 for rotation about the central axis of the cooling member 12. Rotation of the cooling member 12 is driven by a motor 16 (shown in FIG. 2) engaged with the shaft 14. The cooling member 12 is cooled by flowing a refrigerant supplied from an inlet line 18 that flows through flow passages 20 formed within the interior of the cooling member 12. The refrigerant then exits the cooling member 12 through an outlet line 22.

The cooling member 12 has first and second sides, each of which defines a flat annular cooling surface 24, and a peripheral edge 25. Liquid material to be frozen, such as water, is introduced to the cooling surfaces 24. Water from a reservoir 26 is sprayed onto each cooling surface 24 through spray tubes 28. As the water flows over the cooling surfaces 24, it is frozen and then subcooled to form a layer of ice. A pair of ice removal blades 30 are disposed radially on opposite sides of the cooling member 12 and cause flakes of ice to be broken free from the disk surface. A groove 32 is formed in the peripheral edge 25 of the cooling member 12, and is engaged by a guide member 34 that maintains the cooling member 12 centered between the ice removal blades 30, to limit wobble of the cooling member 12.

Construction of the flake ice machine 10 will now be described in greater detail. The flake ice machine 10 includes a housing 36 that forms the liquid reservoir 26 and a trough 38 that receives the lower half of the cooling member 12. The hub assembly 15 including the shaft 14 is mounted across the trough 38. The housing 36 is preferably constructed from a one-piece metal casting.

The cooling member 12 is conventionally constructed, and may be formed from mating disk halves, each of which has been machined or otherwise formed to define a plurality of grooves. The grooves on each half of the cooling member 12 align upon mating to define the internal flow passages 20. Each internal flow passage 20 includes art inlet 40 at the center of the disk and an outlet 42 also at the center of the disk.

The flake ice machine 10 is preferably operated with an evaporative refrigerant, although the present invention is well suited for use with non-evaporative liquid refrigerants. Cold liquid refrigerant is supplied from the inlet line 18 to the inlets 40 of the internal flow passages 20, and flows through the disk to cool the surfaces 24 thereof. As the disk cooling surfaces 24 are cooled, the refrigerant evaporates, and then exits from the outlets 42 of the flow passages 20 to the outlet line 22. Refrigerant exiting the outlet line 22 is then condensed and cooled using a standard refrigeration circuit (not shown). The internal flow passages 20 of the cooling member 12 are formed to evenly cool substantially all of the cooling surfaces 24, as in conventional disks.

The hub assembly 15 is sealed by a plurality of O-ring seals 44, which prevent leakage of refrigerant from the rotating shaft 14 and a non-rotating hub housing 46. The o-ring seals 44 are located in fluid flow communication with the low-pressure outlet line 22.

As mentioned previously, water or other material to be frozen is applied to each cooling surface 24 of the cooling member 12 by spray tubes 28. Each spray tube 28 includes a spaced series of perforations to dispense the water. The spray tubes 28 are formed and positioned such that water flows down one radial side portion and a bottom portion of each cooling surface 24 of the cooling member 12. Excess water then returns to the reservoir 26, which is additionally supplied by an inlet water line 48.

As the cooling surfaces 24 rotate past the spray tubes 28, a layer of frozen ice forms on each cooling surface 24. As the disk rotates further past the spray tubes 28, this material is supercooled so that it is very hard and dry. The ice layer then impacts the ice removal blades 30, where it is broken off in large flakes that slide off over the tops of the removal blades 30, which are set at an upward angle relative to the cooling surfaces 24. The flakes of ice then pass over low friction thermoplastic guide plates 50 secured to the housing 36. The flakes fall free of the housing 36, to be collected in a hopper (not shown) located below the housing 36.

Figure 2:
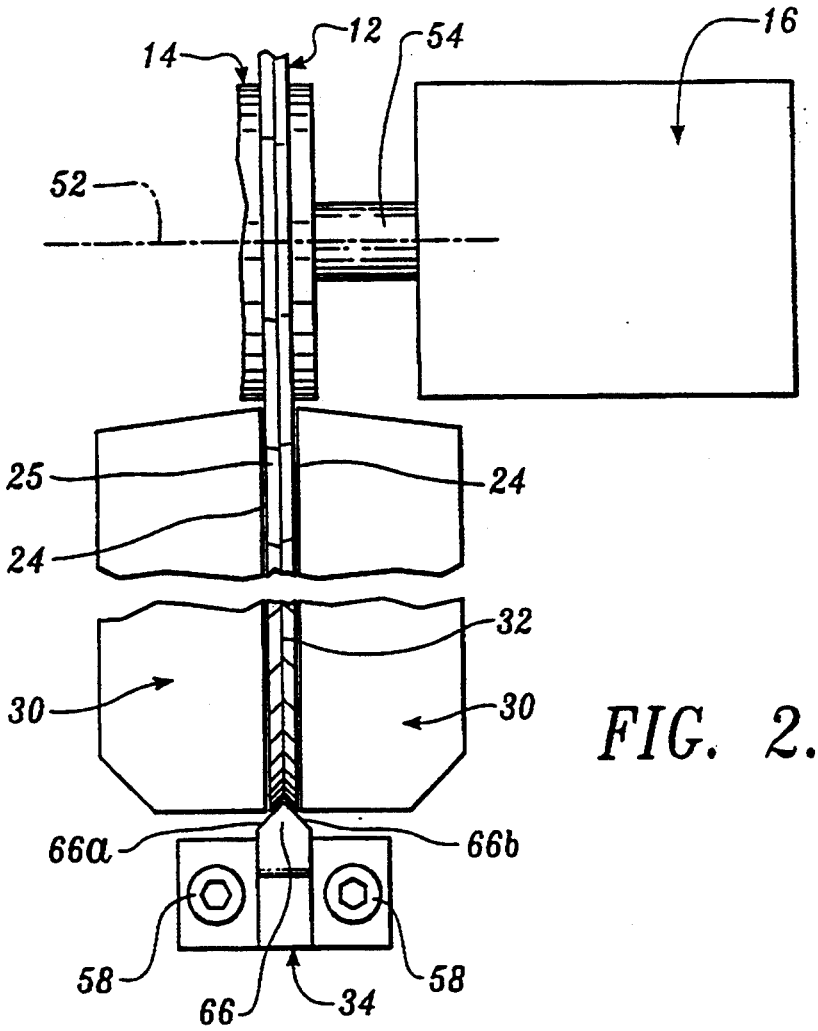
FIG. 2 provides a top plan view of the circumferential edge portion of the cooling disk and engaged guide member, and the center hub portion of the cooling disk of the flexible machine shown in FIG. 1.
Figure 3:
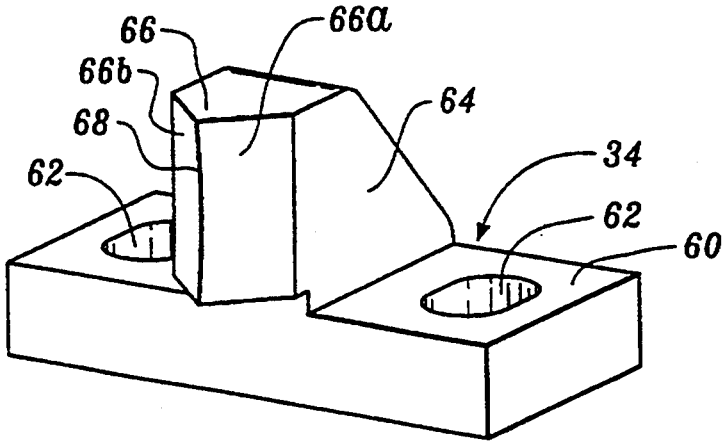
FIG. 3 provides an isometric view of the guide member of the flake ice machine shown in FIG. 1.

Referring to FIGS. 1 and 2, the cooling member 12 and shaft 14 are mounted to rotate on the central axis 52 of the cooling member 12. Rotation is driven by a motor 16, which is engaged with a drive end 54 of the shaft 14 on the opposite side of the cooling member 12 from the refrigerant supply. In a preferred embodiment, the motor 16 is an electric motor that directly drives rotation through a worm gear linkage.

The V-shaped annular groove 32 is formed in the peripheral edge 25 of the cooling member 12. In the preferred embodiment, the width of the groove 32 extends the full width of the peripheral edge 25. While the groove 32 may be either obtusely or acutely angled, in the preferred embodiment it is angled at approximately 90 degrees.

The guide member 34 is secured by bolts 58 to the top of the trough 38 of the housing 36, adjacent to and facing the peripheral edge 25 of the cooling member 12. Referring to FIG., 3, the guide member 34 includes a fiat base portion 60 defining apertures 62 through which the bolts 58 are passed. A center portion 64 of the guide member 34 projects upwardly and forwardly from the base portion 60. The center portion 64 has a pointed forward projection 66 that is formed inversely with respect to the groove 32 in the cooling member 12. Thus, the forward projection 66 includes first and second facets 66a and 66b that join at a vertical edge 68. The facets 66a and 66b, and thus the edge 68, are curved to match the radius of the groove 32 formed circumferentially about the cooling member 12. When the guide member 34 is mounted on the housing 36, the edge 68 aligns with the center of the groove 32 on the cooling member 12. The forward projection 66 of the guide member 34 projects into and is received by the groove 32. Referring to FIG. 1, the top of the center portion 64 of the guide member 34 is disposed slightly higher than the top of the ice removal blades 30. The guide member 34 is preferably constructed from material resistant to wear, such as brass that has been coated with hard chrome.

Referring to FIGS. 1 and 2, as the cooling member 12 covered with frozen ice rotates toward the ice removal blades 30, the center portion 64 of the guide member 34 fractures and removes ice from the peripheral edge 25 of the cooling member 12 just before ice impacts the removal blades 30. The edge defined between the top of the center portion 64 and facets 66a and 66b of the guide member 34 acts as a "plow" that initiates ice removal radially upstream of the ice removal blades 30. Thus, the strong ice that is formed on the annular comers defined by the junction of the cooling surfaces 24 and the peripheral edge 25 is first broken by the guide member 34 so that the ice removal blades 30 may more readily remove ice on the radially outermost portions of the cooling surfaces 24. Because ice is also harvested from the circumferential edge 25, i.e. from the groove 32, the overall efficiency of the cooling member 12 is increased proportional to the increase in total surface area from which ice is harvested.

Referring to FIG. 2, the forward projection 66 of the guide member 34 matches the contour of the groove 32 on the cooling member 12. This enables the guide member 34 to closely engage the cooling member 12 for a non-interference, approximately zero clearance fit. This constrains and centers the radially outermost portion of the disk cooling member 12 between the ice removal blades 30. Regardless of the inherent axial runout of the cooling member 12, disk-wobble is prevented. This permits the ice removal blades 30 to be mounted in dose proximity to the cooling surfaces 24 of the cooling member 12. Preferably, the gap between each ice removal blade 30 and the corresponding cooling surface 24 is less than 0.005 inch. So long as the gap clearance between the facets 66a and 66b of the guide member 34 and the groove 32 of the cooling member 12 is less than the gap clearance between the ice removal blades 30 and the cooling surfaces 24 of the cooling member 12, the ice removal blades 30 never contact the cooling surfaces 24 during rotation of the cooling member 12.

Because of the close approach of the ice removal blades 30 to the cooling surfaces 24 of the cooling member 12, and because the cooling member 12 is constrained by the guide member 34 to prevent wobbling, the flake ice machine 10 is suitable for use in freezing non-saline, fresh water. Flakes of fresh water ice are readily removed by the ice removal tools 30 because the ice removal tools 30 are located in close proximity to the shear joint between the ice and the cooling surfaces 24, and because the guide member 34 prevents the cooling member 12 from deflecting away from the ice removal blades 30.

By way of non-limiting example, a cooling member 12 having a diameter of 15 inches (380 mm) and a thickness of ¼ inch (6 mm) is capable of producing 2200 pounds (1,000 kilograms) of fresh water or saline (sea water) ice during 24 hours of operation, when water to be frozen is supplied at a temperature of 60° F. (16° C.), evaporative refrigerant is supplied at a temperature of less than or equal to 20° F. (7° C.), and the ambient temperature is between 40° F. to 80° F. (5° C. to 26° C.). This capacity is provided by way of illustration only, and the disk cooling member 12 and operation parameters can be varied to adjust the rate of ice production. Likewise, more than one cooling disk member 12 can be mounted in a larger flake ice machine 10 to increase capacity.

While a preferred embodiment of a flake ice machine 10 constructed in accordance with the present invention has been described above, it should be readily apparent that those of ordinary skill in the art will be able to make various alterations and modifications to the design within the scope of the present invention. For example, the cooling member 12 and guide members 34 have been disclosed as including a V-shaped notch and correspondingly contoured guide member. It should be apparent that other means of engaging the circumferential edge could be utilized, such as a groove that defines a semi-circle profile and correspondingly contoured engaging member. Further, the groove need not extend the full width of the circumferential edge of the cooling member 12. Rather than including a groove, the cooling member 12 may include an annular flange formed about its circumferential edge that is received within a corresponding negatively contoured guide member. Because these and other alterations and variations can be made within the scope of the present invention, it is intended that the scope of Letters Patent granted hereon be limited only by the definitions contained in the appended claims and equivalents thereto.

The embodiments of the invention in which an exclusive property or privilege is claimed are defined as follows:

1. A flake ice machine for producing flakes of a frozen material, comprising:

a cooling member mounted for rotation about an axis and defining an annular cooling surface and a peripheral edge about the axis;

a motor coupled to the cooling member to drive rotation of the cooling member;

a refrigerant supply in thermal communication with the cooling member to cool the cooling surface;

a liquid material supply to introduce liquid material to be frozen to the cooling surface of the cooling member;

a removal tool disposed adjacent the cooling surface of the cooling member to remove flakes of frozen material; and means for engaging the peripheral edge of the cooling member to limit wobble of the cooling member relative to the removal tool during rotation.

2. The flake ice machine of claim 1, wherein:

the cooling member comprises a disk defining first and second annular cooling surfaces on opposing sides of the disk; and the removal tool comprises first and second removal blades disposed adjacent the first and second cooling surfaces, respectively, of the disk.

3. The flake ice machine of claim 2, wherein the means for engaging the peripheral edge maintains the disk centered between the first and second removal blades during rotation.

4. The flake ice machine of claim 3, wherein a clearance gap of less than or equal to 0.005 inch is defined between each of the first and second removal blades and the corresponding cooling surface.

5. The flake ice machine of claim 2, wherein:

the peripheral edge of the disk defines a circumferential groove;

the means for engaging the peripheral edge comprises a guide member that is received within the groove of the disk; and the guide member serves to both limit wobble of the disk during rotation and to remove frozen material from the peripheral edge of the disk.

6. The flake ice machine of claim 5, wherein the guide member is disposed proximate and radially upstream of the first and second removal tools.

7. The flake ice machine of claim 1, wherein the peripheral edge of the cooling member defines a circumferential groove and the means for engaging the peripheral edge comprises a guide member that is received within the groove.

8. The flake ice machine of claim 7, wherein the guide member is formed to also remove frozen material from the peripheral edge of the cooling member.

9. The flake ice machine of claim 8, wherein the guide member is disposed proximate to and radially upstream of the removal tool.

10. The flake ice machine of claim 7, wherein the groove has a "V" internal profile and the guide member has an engaging portion that is correspondingly angled to be closely received within the groove.

11. A flake ice machine for producing flakes of a frozen material, comprising:

a rotatable cooling disk defining first and second cooling surfaces and a circumferential edge;

a motor to drive rotation of the cooling disk;

means for cooling the disk;

a liquid material supply to introduce liquid material to be frozen to the first and second cooling surfaces of the cooling disk;

first and second removal tools disposed adjacent the first and second cooling surfaces, respectively, of the cooling disk to remove flakes of frozen material; and a guide member disposed proximate to and engaged with the circumferential edge of the cooling disk to locate the disk between the first and second removal tools during rotation.

12. The flake ice machine of claim 11, wherein the guide member defines a frozen material removal edge that removes frozen material from the circumferential edge of the cooling disk during rotation.

13. A method for producing flakes of a frozen material, comprising:

cooling a rotating cooling disk defining first and second cooling surfaces and a circumferential edge;

applying liquid material to be frozen to the first and second cooling surfaces;

removing flakes of frozen material from the first and second cooling surfaces of the cooling disk using first and second removal tools disposed adjacent the first and second cooling surface; and engaging the circumferential edge of the disk with a guide member during rotation to locate the disk between the first and second removal tools.

14. The method of claim 13, further comprising removing frozen material from the circumferential edge of the disk with the guide member during rotation.

15. The method of claim 14, further comprising locating the guide member proximate to and radially upstream of the first and second removal tools.

16. The method of claim 13, wherein the step of applying liquid material comprises applying salt-free fresh water to the cooling surface.

17. The product produced by the method of claim 16.

18. The method of claim 13, wherein the step of cooling comprises cooling a cooling disk that defines a circumferential groove in the circumferential edge thereof, and the step of engaging the circumferential edge comprises receiving a projection defined by the guide member in the groove.

19. The product produced by the method of claim 13.

* * * * *